US007820247B2

(12) United States Patent
Morita et al.

(10) Patent No.: US 7,820,247 B2
(45) Date of Patent: Oct. 26, 2010

(54) CURTAIN-TYPE COATER

(75) Inventors: Hirofumi Morita, Tokyo (JP); Akio Hirano, Chiba (JP); Hiroyuki Kohno, Fukushima (JP)

(73) Assignee: Voith Paper Patent GmbH, Heidenheim (DE)

( * ) Notice: Subject to any disclaimer, the term of this patent is extended or adjusted under 35 U.S.C. 154(b) by 282 days.

(21) Appl. No.: 11/130,185

(22) Filed: May 17, 2005

(65) Prior Publication Data

US 2005/0271825 A1 Dec. 8, 2005

(30) Foreign Application Priority Data

May 18, 2004 (JP) ..... 2004-147611

(51) Int. Cl.
*B05D 1/30* (2006.01)
*B05C 5/00* (2006.01)

(52) U.S. Cl. ..... 427/420; 118/324; 118/325

(58) Field of Classification Search ..... 427/420
See application file for complete search history.

(56) References Cited

U.S. PATENT DOCUMENTS 3,341,354 A * 9/1967 Gordy et al. ..... 427/288
4,230,743 A * 10/1980 Nakamura et al. ..... 427/146
5,902,648 A 5/1999 Naka et al.

FOREIGN PATENT DOCUMENTS

| | | | |
|---|---|---|---|
| JP | 08-001061 | | 1/1996 |
| JP | 09-038559 | * | 2/1997 |
| JP | 10-165869 | * | 6/1998 |

OTHER PUBLICATIONS

English translation of Japan 09-038559, originally published in Japanese Feb. 10, 1997.*
English translation of Japan 10-165869, originally published in Japanese Jun. 23, 1998.*
English language Abstract of JP 08-001061.

* cited by examiner

*Primary Examiner*—Katherine A Bareford
(74) *Attorney, Agent, or Firm*—Greenblum & Bernstein, P.L.C.

(57) ABSTRACT

Curtain-type coater and process for coating a web with curtain-type coater. Curtain-type coater includes a curtain head having a slit structured and arranged to supply a coating liquid curtain onto a surface of a web and outside of the edges of the web. At least a portion of the slit forming the coating liquid curtain outside the edges of the web has a width greater than a portion of the slit forming the coating liquid curtain supplied onto the web.

12 Claims, 7 Drawing Sheets

Cross section along the line B-B of FIG. 1 (b)

Cross section along the line C-C of FIG. 1 (b)

CURTAIN-TYPE COATER

CROSS-REFERENCE TO RELATED APPLICATIONS

The present application claims priority under 35 U.S.C. §119 of Japanese Patent Application No. 2004-147611 filed May 18, 2004, the disclosure of which is expressly incorporated by reference herein in its entirety.

BACKGROUND OF THE INVENTION

1. Field of the Invention

The present invention relates to a curtain-type coater for coating paint from above onto a paper web or the like.

2. Discussion of Background Information

The manufacture of coated paper employed for use in catalogues and as heat-sensitive paper and tickets for automated ticketing machines and so on has hitherto involved the coating of a coating liquid onto the surface of a raw material paper web.

Machines used for the coating of coating liquids such as this are referred to as coaters and, of these coaters, those used for the coating of a coating liquid onto a paper web or the like are referred to as curtain-type coaters.

As illustrated in FIG. 6*a*, in order to coat a coating liquid of a prescribed width onto a web upper surface, a curtain-type coater 100 jets a coating liquid held within a head body 101 in a curtain tc shape from above onto a web surface (not shown in the diagram) being carried in the direction perpendicular to the plane of the paper of FIG. 6*a*.

Although different depending on the type of coating liquid t that is used, generally speaking, in the use of the curtain-type coater 100 for the formation of a low flow rate curtain tc of no more than 6 to 7 liters/min/meter width, the edge parts ce of the curtain tc, as illustrated in FIG. 6*b*, are pulled toward the inner side due to an inner side-directed surface tension which causes instability of the curtain tc of the coating liquid t.

In a curtain-type coater 200 designed to resolve this problem as illustrated in FIG. 7, guide bars gb or guide plates for guiding the curtain tc of the curtain liquid t to prevent the instability thereof are arranged in both ends of a slit (not shown in the diagram) which serves as a jet for the coating liquid t that is held in a head body 201.

It is noted that Japanese Unexamined Patent Application No. 8-1061 discloses a representative example of technology of the prior art pertaining to this application.

By the way, in the use of a general curtain-type coater 100 as described above, when the flow rate of the coating liquid being jetted is low, the edge parts ce of the curtain tc are pulled toward the inner side due to surface tension causing instability of the curtain tc of the coating liquid t.

In addition, if this flow rate is further decreased, a curtain tc of a mottled and raindrop-like spattered state is produced, and maintenance of the prescribed coating performance becomes difficult to achieve.

The resolution of this problem necessitates a flow rate of the coating liquid t of a fixed rate or above which results in the undesirable and unavoidable outcome of excess use of the coating liquid t.

On the other hand, there is a problem inherent to the use of a curtain-type coater 200 in which guide bars gb or guide plates are arranged in that, when the coating operation is continued for long periods, the coating liquid t affixes to the guide bars gb and guide plates and subsequently dries and solidifies which, in the end, disturbs the curtain tc and results in a loss of the guiding function thereof.

In addition, interference between the guide bars gb and guide plates with color pans (not shown in the diagram) for collecting the coating liquid occurs at the initiation of coating and results in an undesirable disturbance of the curtain tc of the coating liquid t.

In addition, the arrangement of guide bars gb and guide plates creates an obstruction to a range of operations including maintenance and, accordingly, reduces the operability of the device.

SUMMARY OF THE INVENTION

An present invention provides a curtain-type coater which, based on a simple configuration, affords a stabilizing of the coating liquid curtain and the production of a high coating performance and, furthermore, the use of a low volume of coating liquid.

According to the invention, the curtain-type coater jets a coating liquid through a slit of a curtain head onto a carried web from above forming coating liquid curtains by which the coating liquid coats the abovementioned web upper surface. The width of at least some part of the slit, through which the coating liquid curtains forming on the outside of the web upper surface are jetted, is wider than the slit through which the coating liquid curtain forming on the web upper surface is jetted.

The curtain-type coater includes at least the two end parts of the abovementioned slit of the curtain head are formed wider in width than the remaining section.

Additionally or alternatively, the width dimension of the abovementioned slit formed wider in width is no less than twice the width dimension of the width of the remaining part of the slit.

According to an exemplary embodiment of the invention, the curtain-type coater has a width of at least some part of the slit through which the coating liquid curtains that form on the outside of the web upper surface are jetted is wider than the slit through which the coating liquid curtain that forms on the web upper surface is jetted. As a result, the flow rate through the slit of wider width for the curtain liquid curtain outside the web upper surface is increased, whereupon the effect on the coating liquid curtain of the surface tension of the coating liquid toward the inner side is reduced and disturbance of the coating liquid curtain on the web upper surface is prevented.

Accordingly, a curtain-type coater that affords the formation of a stable coating liquid curtain at a low flow rate, a high coating performance, and a reduced flow rate of the coating liquid can be produced.

Moreover, as at least the two end parts of the abovementioned slit of the curtain head are formed wider in width than the remaining section, the width of the curtain-type coater can be narrowed.

Because the width dimension of the abovementioned slit formed wider in width is no less than twice the width dimension of the width of the remaining part of the slit, a flow rate of the coating liquid of a fixed volume or above is formed, the force in the direction in which the coating liquid curtain jetted is increased, and a more stable coating liquid curtain is able to be obtained.

The present invention is directed to a curtain-type coater that includes a curtain head having a slit structured and arranged to supply a coating liquid curtain onto a surface of a web and outside of the edges of the web. At least a portion of the slit forming the coating liquid curtain outside of the edges of the web has a width greater than a portion of the slit forming the coating liquid curtain supplied onto the web.

According to the invention, coating liquid can be supplied to the slit under pressure.

In accordance with a further feature of the instant invention, the curtain head may be positioned above an upper surface of the web.

At least end parts of the slit can be wider in width than a remaining portion of the slit.

According to another feature of the invention, the greater width of the at least a portion of the slit forming the liquid curtain outside of the edges of the web is no less than twice the width of the portion of the slit forming the coating liquid curtain supplied onto the web.

The instant invention is directed to a process for coating a web. The process includes supplying a coating liquid through a slit in a curtain head to form a coating liquid curtain that extends across the web and beyond the edges of the web. The flow rate for the coating liquid through at least a part of the slit forming the coating liquid curtain beyond the edges of the web is greater than the flow rate for the coating liquid through at least a part of the slit forming the coating liquid curtain extending across the web.

In accordance with the invention, the greater flow rate is achieved through a wider slit in the portion of the slit forming the coating liquid curtain beyond the edges of the web than in the portion of the slit forming the coating liquid curtain extending across the web. Further, the greater width of the at least a portion of the slit forming the liquid curtain beyond the edges of the web is no less than twice the width of the portion of the slit forming the coating liquid curtain extending across the web.

The invention is directed to a curtain-type coater including a curtain head having a slit structured and arranged to supply a coating liquid curtain across a surface of a web and beyond the edges of the web. The slit is structured supply the coating liquid through at least a portion of the slit forming the coating liquid curtain beyond the edges of the web at a greater flow rate than through a portion of the slit forming the coating liquid curtain supplied onto the web.

In accordance with still yet another feature of the present invention, a portion of the slit in the portion of the slit forming the coating liquid curtain beyond the edges of the web is wider than the portion of the slit forming the coating liquid curtain across the web.

The invention is directed to a process for coating a web with an above-described curtain-type coater. The process includes forming a coating liquid curtain having an extent greater than a width of the web, drawing the web through the curtain, and supplying the coating liquid through at least a portion of the slit forming the coating liquid curtain outside of the edges of the web, which has a width greater than a portion of the slit forming the coating liquid curtain supplied onto the web.

The invention is directed to a process for coating a web with another above-described curtain-type coater. The process includes forming a coating liquid curtain having an extent greater than a width of the web, drawing the web through the curtain, and supplying the coating liquid through at least a portion of the slit forming the coating liquid curtain beyond the web at a greater flow rate than through a portion of the slit forming the coating liquid curtain supplied onto the web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1B:
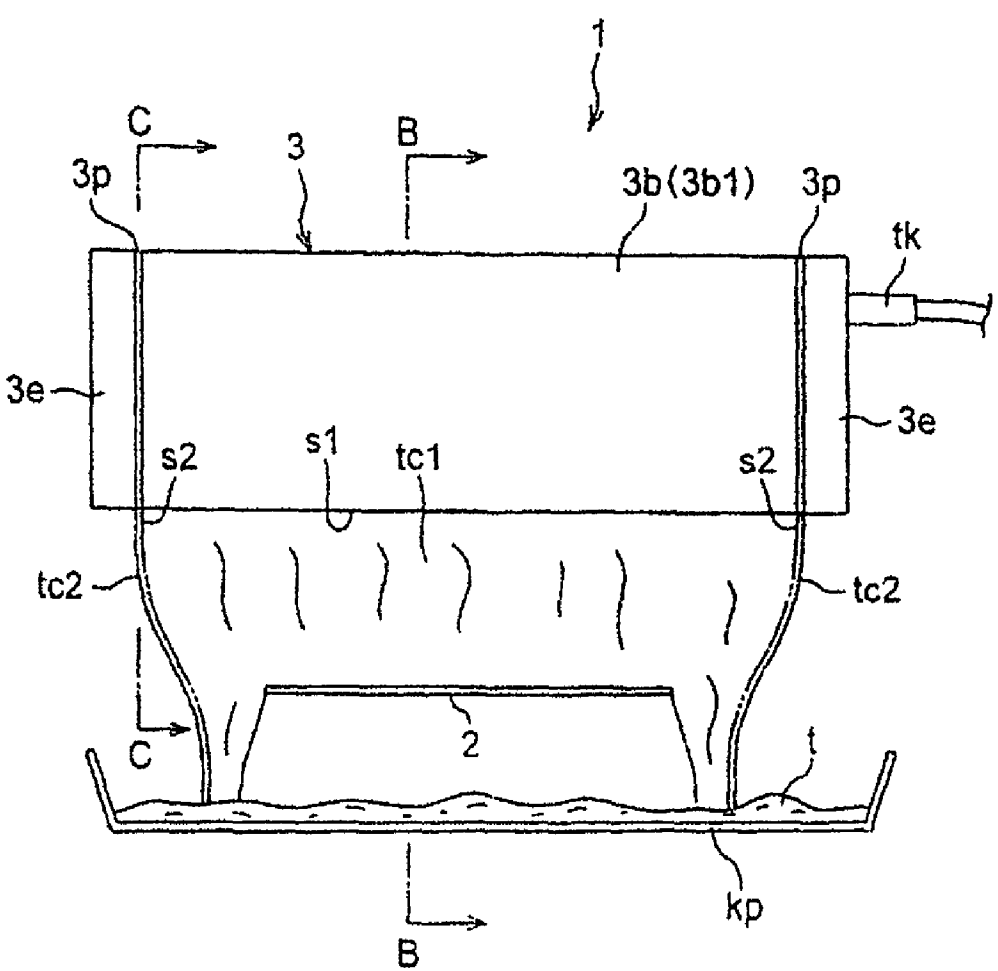
FIG. 1*b* is a view along the direction A depicted in FIG. 1*a;*
Figure 1A:
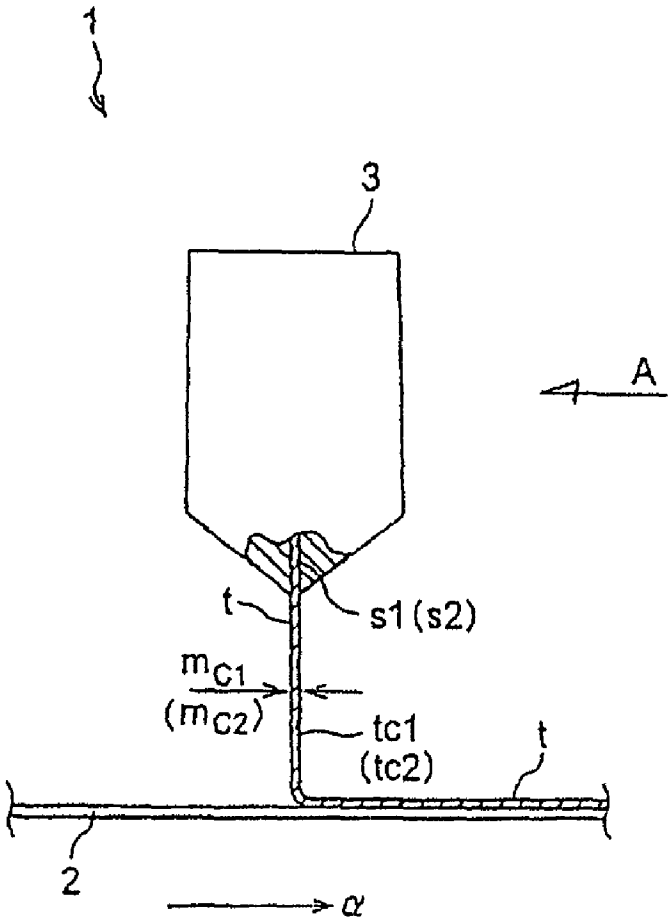
FIG. 1*a* schematically illustrates the coating operation of the curtain-type coater of an exemplary embodiment of the present invention.

As illustrated in FIG. 1*a* which presents a schematic view thereof, a curtain-type coater 1 of embodiment 1 of the present invention constitutes a device in which a web 2, which is a raw material paper, is carried in the direction of the arrow a at a speed of 100 to 2000 meters/minute to coat a coating liquid t on the upper surface of the web 2.

As illustrated in FIG. 1*b*, which is a view along the direction A of FIG. 1*a*, by the jetting of a coating liquid t supplied from a coating liquid supply port tk to a chamber (described later) of a curtain head 3 through a slit s1 and slits of wider width s2, s2 toward the upper surface of a carried web 2 in a curtain form to form coating liquid curtains tc1, tc2, the curtain-type coater 1, forms a coating liquid layer of a prescribed thickness of, for example, 10 to 50 μm thickness, on the web 2 upper surface.

According to the invention, the coating liquid curtain end parts tc2, tc2 form a part of the coating liquid curtain located outside the edges of the upper surface of web 2 having a formed thickness mc2 of 1 to 3 mm, in contrast to a formed thickness mc1 of 0.3 mm for the coating liquid curtain inner part tc1, i.e., directed onto the upper surface of web 2. In this regard, the flow rate for the coating liquid curtain end parts tc2, tc2 is greater than that of coating liquid curtain inner part tc1 and, as a result of this increased volume of coating liquid, the surface tension of the coating liquid t acting on the coating liquid curtain end parts tc2, tc2 is resisted and the coating liquid curtain tc is stabilized.

The curtain-type coater 1 based on the present configuration facilitates the attaining of the prescribed coating performance with a coating liquid t of low flow rate.

Next, a description will be given of the configuration of the curtain-type coater 1.

As illustrated in FIG. 1, the coating liquid t jetted through the slits s1, s2 of the curtain head 3 forms coating liquid curtains tc1, tc2 so as to coat a prescribed amount of coating liquid on the upper surface of the web 2, and the excess of coating liquid t jetted outside the web 2 upper surface 2 and not used for the coating is recovered by a color pan kp as illustrated in FIG. 1*b*.

Figures 2A, 2B, 2C:
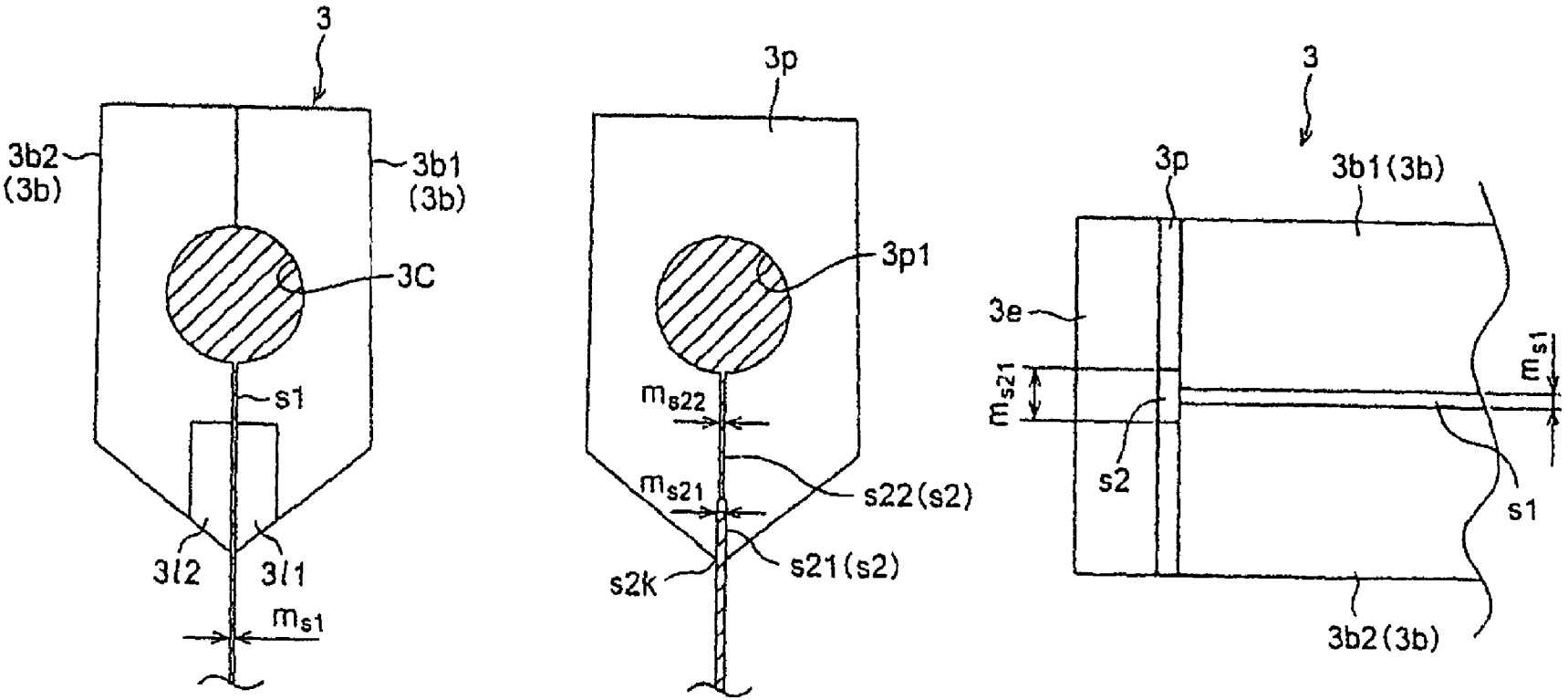
FIG. 2*a* is a cross section along the line B-B of the curtain head depicted in FIG. 1*b;*
FIG. 2*b* is a cross section along the line C-C of the curtain head of FIG. 1*b;*
FIG. 2*c* is a bottom view of the curtain head of the curtain-type coater depicted in FIGS. 1*a* and 1*b;*

The recovered coating liquid t is returned to a tank (not shown in the diagram) and, together with newly supplied coating liquid t, is subjected to a prescribed pressure by a pump and recirculated whereupon, by way of a defoamer and filter and the like, is passed through a coating liquid supply port tk again and fed to a chamber 3*c* of the curtain head 3 (see FIG. 2*a* which is a cross section along the line B-B of the curtain head of FIG. 1*b*).

The coating liquid t fed to the chamber 3*c* is jetted (i.e., supplied under pressure) through the slits s1, s2 in curtains tc1, tc2 onto the web 2 upper surface that are coated on the web 2 upper surface.

As illustrated in FIG. 1*b*, the abovementioned curtain head 3 is configured from a head body 3*b*, packings 3*p*, 3*p* for sealing said head body 3*b* to prevent leak of the coating liquid t, and end plates 3*e*, 3*e* for holding the packings tightly against the head body 3*b*.

As illustrated in FIG. 2*c*, which is a bottom view of the curtain head of FIG. 1*b*, the curtain head 3 comprises a slit s1 of width dimension ms1 of 0.3 mm provided in head bodies 3*b*1, 3*b*2 that form a coating liquid curtain inner part tc1, and slits s2, s2 of width dimension ms21 of 1 to 3 mm provided in the packings 3*p*, 3*p* that form coating liquid curtain end parts tc2, tc2.

It is preferable that the width dimension ms21 of the slit s2 is no less than 0.6 mm, and most preferable that the width dimension be between 1 to 3 mm, while the width dimension ms1 of slit s1 is 0.3 mm.

By the formation of the width dimension ms1 of the slit s1 and the width dimension ms 21 of the slit s2 to be different in this way, the flow rate for the formation of the curtain liquid end parts tc2, tc2 is greater than the flow rate for the formation of the coating liquid curtain inner part tc1.

It should be noted that, although the present embodiment illustrates a case in which the width dimension ms1 of the slit s1 is taken as 0.3 mm, a width dimension of 0.2 to 0.5 mm may be adopted and, moreover, the width dimension ms1 of the slit s1 and the width dimension ms21 of the slit s2 can be selected as appropriate in accordance with the coating conditions including the thickness of the coating liquid layer to be coated on the web 2.

As illustrated in FIG. 2*a* and FIG. 2*c*, the head body 3*b* comprises a first head body 3*b*1 and a second head body 3*b*2 that form the main body thereof, and a first rib 3*l*1 and a second rib 3*l*2 for adjusting the slit s1 width thickness housed in the first head body 3*b*1 and the second head body 3*b*2 respectively.

The first head body 3*b*1 and the second head body 3*b*2 are formed from, for example, stainless steel and, as illustrated in FIG. 1*b* and FIG. 2*c*, they each comprise a chamber 3*c* of a prescribed shape and a notch part that forms a single side part of the slit s1 of fixed width 0.3 mm and are manufactured in a length that corresponds to a web 2 width of, for example, no less than 1 to 5 m.

The first rib 3*l*1 and the second rib 3*l*2 are formed of, by way of example, stainless steel, and a hole though which a slit width adjustment bolt (not shown in the diagram) is inserted is provided in one part of the slit s1 of width 0.3 mm illustrated in FIG. 2*a*.

The packings 3*p*, 3*p* illustrated in FIG. 2*b*, which is a cross section along the line C-C of FIG. 1*b*, are a rubber product manufactured from, for example, butadiene rubber and, as illustrated in FIG. 2*c*, a slit s2 comprising a slit s21 of width dimension ms21 of 1 to 3 mm provided about a slit s1 of the head bodies 3*b*1, 3*b*2 and, juxtaposed with the slit s1 of the head bodies 3*b*1, 3*b*2, a slit s22 of width dimension ms22 of 0.3 mm are formed, and a hole 3*p*1 corresponding to the chamber 3*c* of the head body 3*b* is formed.

Because, in this way, the width dimension ms21 of the slit s21 of the slit s2 is 1 to 3 mm and is larger than the width dimension ms1 (=0.3 mm) of the slit s1, the cross sectional area thereof is larger than the cross sectional area of the slit s2 and, accordingly, the coating liquid t flows at a greater flow rate to the slit s2 than the slit s1 and the thickness of the coating liquid curtains tc2, tc2 through the slit s2 is greater than the thickness of the coating liquid curtain tc1 through the slit s1.

Although, as illustrated in FIG. 2*b*, the example described above illustrates a case in which the wider width part s21 of the slit s2 provided in the packing 3*p* is formed inward of a slit opening s2*k* along a part of the entire length of the slit s2, provided it is formed inward of the slit port s2*k*, this wider width part may be formed along the entire length of the slit s2 or, instead, it may be formed across a part thereof as is the case in this embodiment.

Based on the above-described configuration, as illustrated in FIG. 1*b* and FIG. 2*c*, by the forming of part of the slit that forms the coating liquid curtain outside of the web 2 upper surface as slits s2, s2 for the coating liquid curtain two end part tc2, tc2 that are wider in width than the slit s1 for the coating liquid curtain inner part tc1 side that is formed on the web 2 upper surface, the flow rate for the coating liquid curtain end parts tc2, tc2 is increased and, as a result of this increased flow rate, the effect of the surface tension acting on the coating liquid curtain end parts tc2, tc2 toward the inner side is reduced and pull on the coating liquid curtain end parts tc2, tc2 to the inner side is prevented.

For this reason, disturbance of the coating liquid curtain can be prevented, stabilization of the coating liquid curtains can be achieved, and a coating operation that is stable, and of high quality, can be implemented.

In addition, by virtue of the fact, by increasing the flow rate for the coating liquid curtain end parts tc2, tc2, a stabilizing of the coating liquid curtain can be achieved, the total flow rate of the coating liquid tc1 can be reduced.

By way of example, while on the one hand a flow rate of 7.4 liters/minute/meter width has been found to be necessary in the prior art to obtain the prescribed coating performance, it was able to be confirmed that, if the width dimension ms21 of the slit s2 for forming the coating liquid curtain end parts tc2, tc2 which constitute the part of the coating liquid curtain outside the web 2 upper surface is formed to 3 mm as opposed to the width dimension ms1 of 0.3 mm of the slit s1 for forming the coating liquid curtain inner part tc1 on the upper surface web 2, the volume of coating liquid was able to be reduced to a flow rate of 5.4 liters/minute/meter width.

In addition, by virtue of the fact that, based on a configuration in which the flow rate for the coating liquid curtain end parts tc2, tc2 is increased in this way, the contraction of the curtain end parts is small, a stabilization of the coating liquid curtain at the narrowest possible width dimension can be achieved and, in addition, the overall dimensions of the curtain-type coater can as far as possible be reduced.

Accordingly, based on a simple configuration, a curtain-type coater that facilitates a stabilizing of the coating liquid curtain and the production of a high coating performance and, furthermore, the use of a low volume of coating liquid can be produced.

For this reason, the field of utilization of the curtain-type coaters can be expanded and, moreover, a broadening of the general use of curtain-type coaters is facilitated.

Figures 3A, 3B, 3C, 3D:
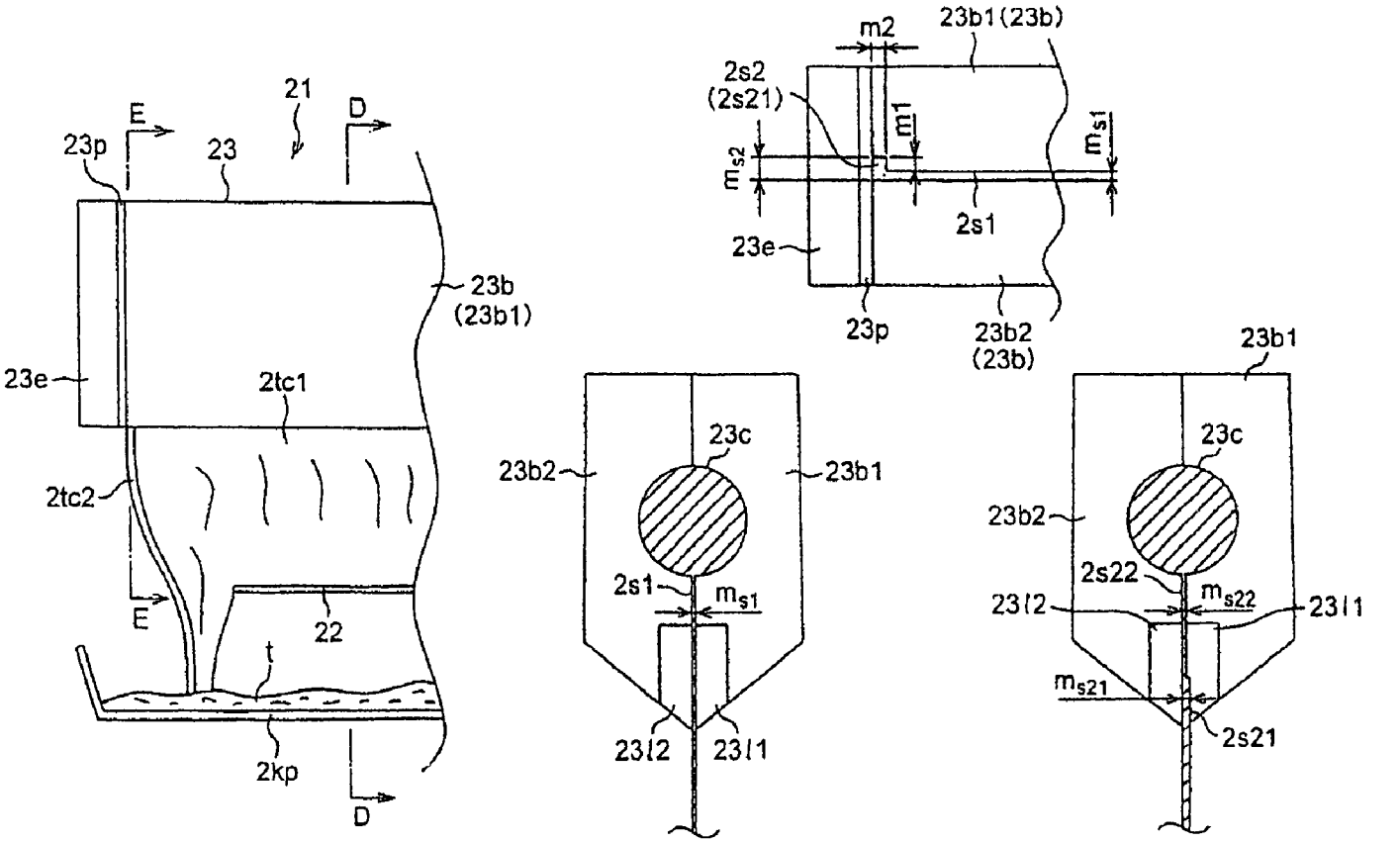
FIG. 3*a* is a diagram of the coating operation of the curtain-type coater another embodiment of the present invention.
FIG. 3*b* is a bottom view of the curtain head of the curtain-type coater depicted in FIG. 3*a;*
FIG. 3*c* is a cross section along the line D-D of the curtain head depicted in FIG. 3*a;*
FIG. 3*d* is a cross section along the line E-E of the curtain head of depicted in FIG. 3*a;*

As illustrated in FIG. 3*a* and FIG. 3*a*, which is an expanded bottom view of the curtain head 23 of FIG. 3*a*, a curtain-type coater 21 of embodiment 2 of the present invention is configured by the formation of a slit 2*s*1 and slits of wider width 2*s*2, 2*s*2 in a head body 23*b* only without the slits being formed in packings 23*p*, 23*p* of a curtain head 23.

In this configuration, by the jetting of a coating liquid t onto a web upper surface 22 by way of a slit 2*s*1 of the head body 23*b* to form a coating liquid curtain inner part 2*tc*1 and, in addition, the jetting of a coating liquid t by way of slits 2*s*2, 2*s*2 to form coating liquid curtain end parts t2*c*2, 2*tc*2 of greater flow rate onto part of the coating liquid curtain outside the web 22 upper surface, a stabilization of the coating liquid curtains 2*tc*1, 2*tc*2 is achieved and, as a result, the prescribed coating performance is ensured.

As illustrated in FIG. 3*c*, which is a cross section along the line D-D of the curtain head 23 of FIG. 3*a*, in order for the curtain-type coater 21 to form the coating liquid curtain inner part 2*tc*1, a chamber 23*c*, to which the coating liquid t from the first head body 23*b*1 and second head body 23*b*2 is fed, is formed, and a slit 2*s*1 with a width dimension ms1 is formed with through-connection to the chamber 23*c*.

One or both of a first rib 23*l*1 and a second rib 23*l*2 are adjustably supported by adjustable bolts in the first head body 23*b*1 and the second head body 23*b*2 and, in addition, a slit 2*s*1 in said first rib 23*l*1 and second rib 23*l*2 is formed continuously as a slit 2*s*1 of the first head body 23*b*1 and second head body 23*b*2.

On the other hand, as illustrated in FIG. 3*a*, in order to form coating liquid curtain end parts 2*tc*2, 2*tc*2 of large flow rate that are formed at the outside of the upper surface of the web 22, as illustrated in FIG. 3*d*, which is a cross section along the line E-E of the curtain head 23 of FIG. 3*a*, a slit 2*s*22 of width dimension ms22 the same as the width dimension ms1 juxtaposedly arranged with the slit 2*s*1 with connection to the chamber 23*c* is formed in the first head body 23*b*1 and second head body 23*b*2.

In addition, a slit 2*s*22 in the first rib 23*l*1 and second rib 23*l*2 adjustably supported by adjustable bolts of each of the first head body 23*b*1 and second head body 23*b*2 is formed continuously with the slit 2*s*22 of the first head body 23*b*1 and second head body 23*b*2 and, in addition, a slit 2*s*21 of expanded width on the first rib 23*l*1 side and of width dimension ms21 greater than the width of the slit 2*s*22 is formed on the lower part thereof.

Here, taking the width dimension ms1 of the slit 2*s*1 of the coating liquid curtain inner part 2*tc*1 as 0.3 mm, the width dimension ms2 of the slits 2*s*2, 2*s*2 for the coating liquid curtain end parts 2*tc*2, 2*tc*2 must be at least 0.6 mm or more, and more preferably 1 to 3 mm.

The same action and effect as produced with embodiment 1 is achieved using the configuration of the above-described embodiment 2.

Next, a description will be given with reference to FIG. 4 of modified examples 1, 2 of embodiment 2.

Figure 4A:
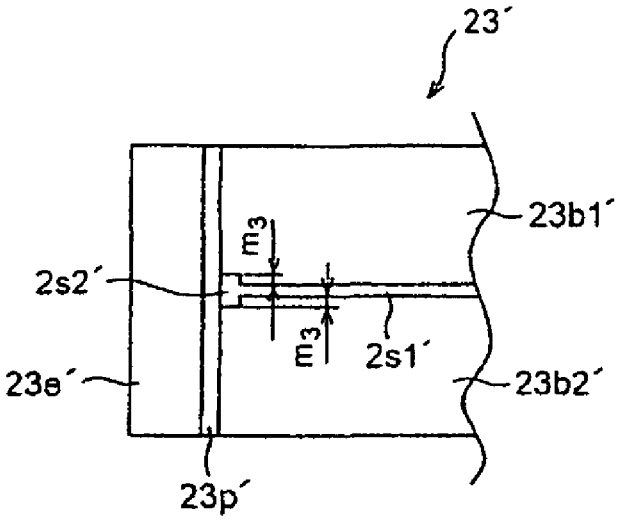
FIG. 4*a* is a bottom view of a modification to the embodiment depicted in FIG. 3*b;*

As illustrated in FIG. 3*a*, although an example is given in the above-described embodiment 2 of a case in which, when the width of slits 2*s*2, 2*s*2 for forming the coating liquid curtain two end parts 2*tc*2, 2*tc*2 is to be formed wider, the slit is formed wider only in the first head body 23*b*1, as illustrated in FIG. 4*a* which is a bottom view thereof, a curtain head 23' of modified example 1 is provided with an identical dimension m3 for each of a first head body 23*b*1' and a second head body 23*b*2' forming slits 2*s*2', 2*s*2' of wider width in the two end parts.

It should be noted that, although this modified example cites a case in which slits 2*s*2', 2*s*2' are symmetrically provided with respect to the bonded face between the first head body 23*b*1' and second head body 23*b*2', they need not be provided symmetrically.

Figure 4B:
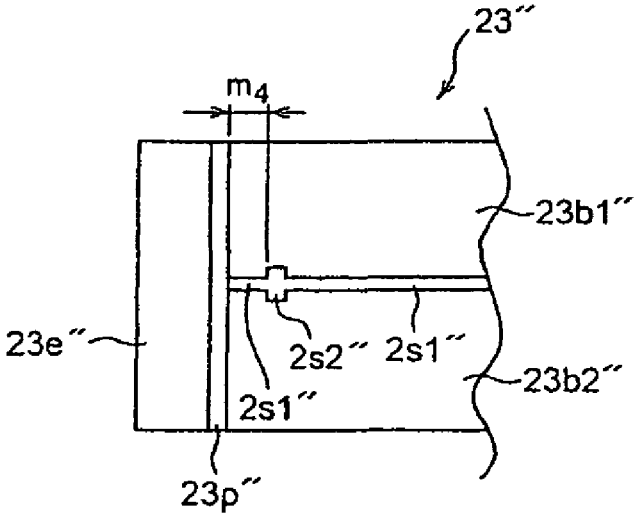
FIG. 4*b* is a bottom view of modified embodiment depicted in FIG. 4*a;*

In addition, as illustrated in FIG. 4*b* which constitutes a bottom view thereof, in the curtain head 23" of modified example 2, slits 2*s*2", 2*s*2" of wider width that form a section of the coating liquid curtain of thicker film thickness are provided in positions separated by a dimension m4 from the end edges of a first head body 23*b*1" and a second head body 23*b*2".

In this way, it is not necessarily the case that the slits 2*s*2", 2*s*2" of wider width must be formed in the end parts of the coating liquid curtain and, accordingly, they may be formed in positions other than the two end parts of the coating liquid curtain.

That is to say, as illustrated in FIG. 1*b* and FIG. 3*a*, the position in the curtain head of the slits of wider width is outside the web 2 upper surface and, provided this position is one that facilitates the prevention of the disturbance of the coating liquid curtain, there are no particular limitations to the position.

In addition, although the above-described embodiments 1, 2 cite examples of a case in which the slits of wider width are located in both sides on the outside of the web upper surface, a constant effect will be obtained even if a slit is provided in only one side outside the web upper surface.

In addition, the slits of wider width may be provided in the first head body and the second head body and, as illustrated in embodiment 1, they may be provided in a packing for sealing the head body or continuously with the head body and the packing and, accordingly, the member part in which the slits of wider width are provided can be selected as appropriate.

Figure 5C:
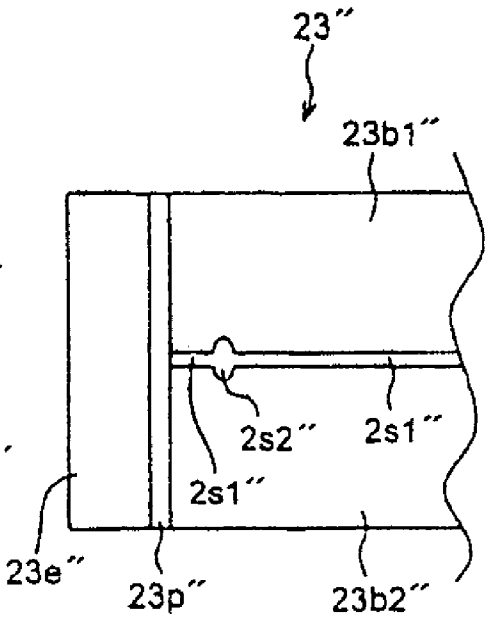
FIGS. 5*a*, 5*b*, and 5*c* are bottom views of curtain heads illustrating modified cross sectional shapes for the slits in accordance with the invention.
Figure 5B:
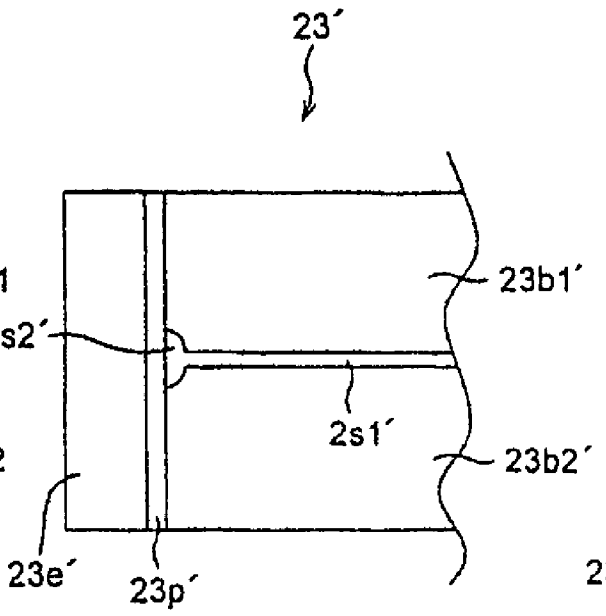
Figure 5A:
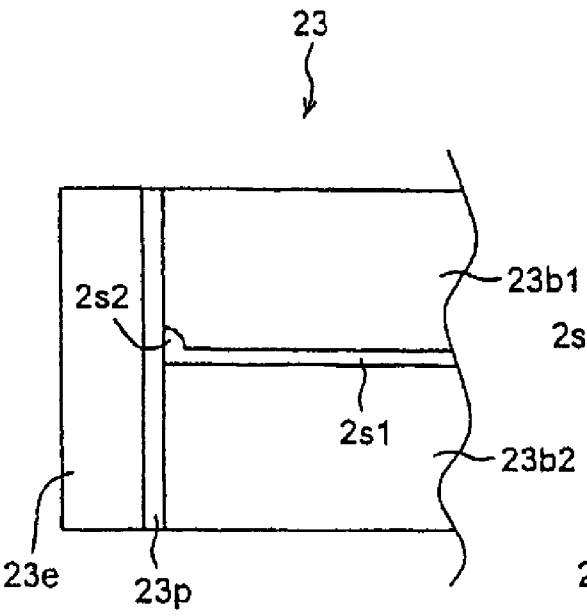
Figure 6A:
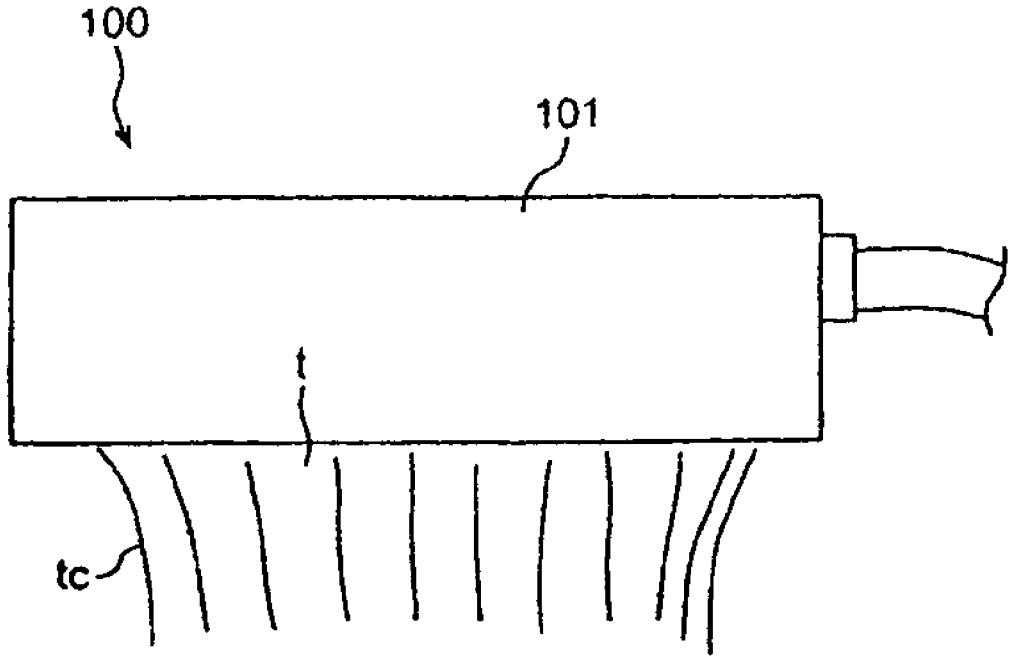
FIG. 6*a* diagrammatically illustrates the coating operation of the curtain-type coater of the prior art.
Figure 6B:
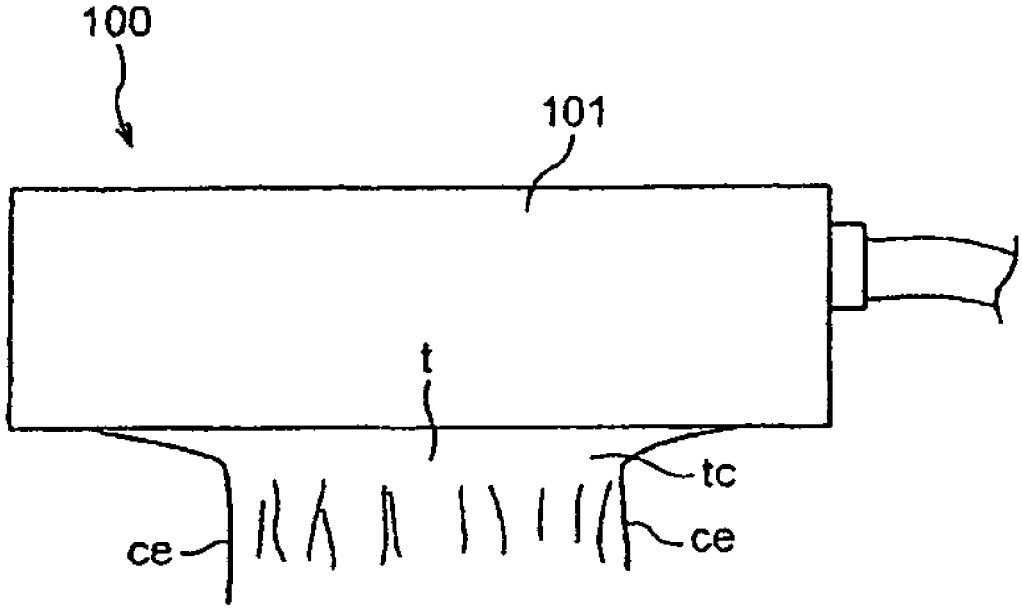
FIG. 6*b* is a diagram of a coating operation where the coating liquid of the curtain-type coater depicted in FIG. 6*a* is a low flow rate.
Figure 7:
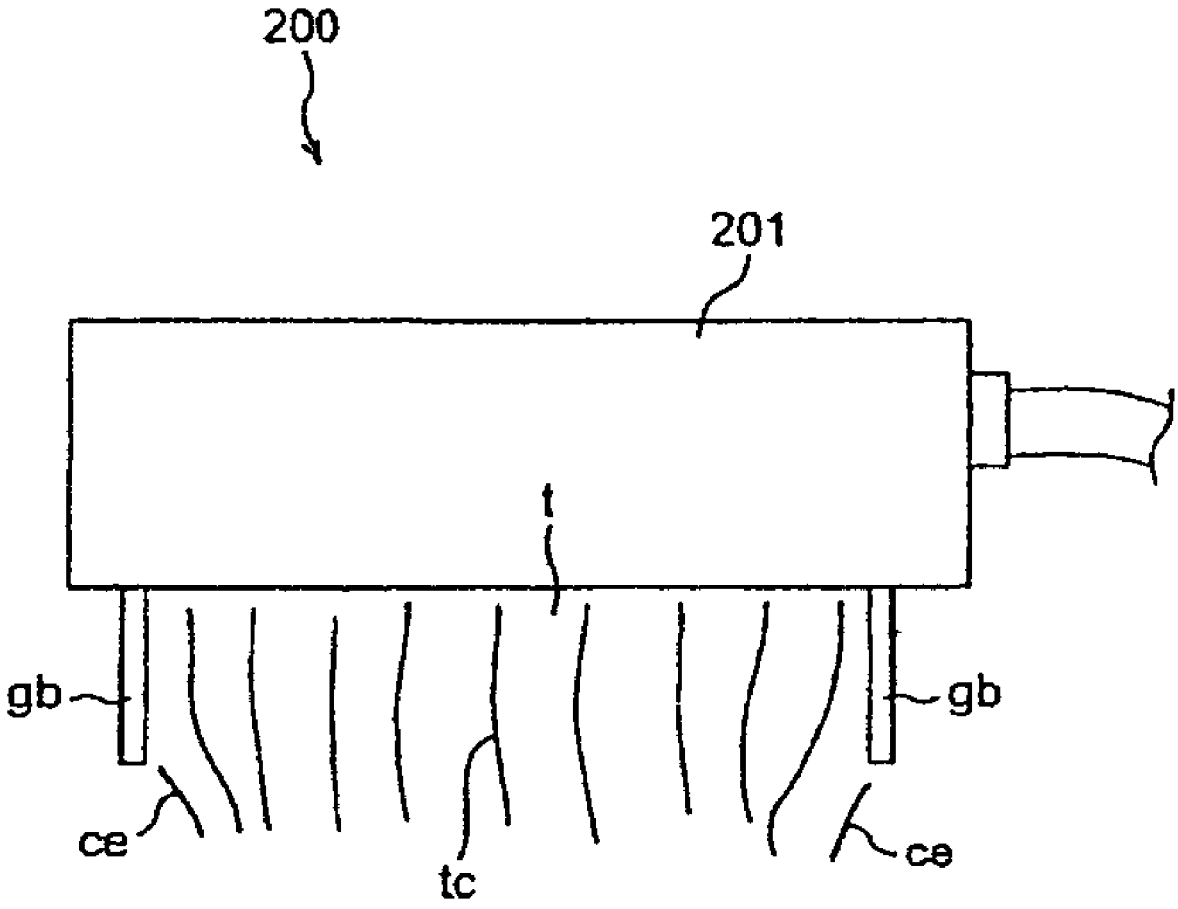
FIG. 7 diagrammatically illustrates the coating operation of the curtain-type coater with guide plate of the prior art.

It should be noted that, although embodiment 1 and embodiment 2 cite examples in which the cross sectional shape of the slit of wider width is a square, the cross sectional shape of the slit 2*s*2 of wider width illustrated in FIG. 3*a* may be a circular shape as illustrated in FIG. 5*a*, the cross sectional shape of the slit 2*s*2' of wider width illustrated in FIG. 4*a* may also be a circular shape as illustrated in FIG. 5*b* and, similarly, the cross sectional shape of the slit 2*s*2" of wider width illustrated in FIG. 4(*b*) may also be a circular shape as illustrated in FIG. 5*c*.

In this way, provided the film thickness of the coating liquid curtain to be formed is a dimension that is at least twice the film thickness of the coating liquid curtain formed by the remainder of the slit, the cross sectional shape adopted for the slit of wider width illustrated may include shapes other than a circle including an elliptical shape.

As practical examples thereof, provided the curtain-type coater is used as a coater or the like for the coating of paint on, for example, calendars, catalogues, pressure-sensitive paper, heat-sensitive paper and photographic film or a coater or the like for the coating of magnetic material on a single side of tickets for automated ticket gates, the invention has broad applicability without particular restriction to the range of the application thereof.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LISTING OF REFERENCE NUMBERS

1, 21 Curtain-type coater
2, 22 Web
3, 23, 23', 23" Curtain head
s1, 2*s*1, 2*s*1', 2*s*1" Slit
s2, 2*s*2, 2*s*2' Slit end parts (Slits formed of wider width)
2*s*2" Slit formed of wider width
tc1, tc2, 2*tc*1, 2*tc*2 Coating liquid curtain
tc1, 2*tc*1 Coating liquid curtain formed on the web upper surface
tc1, tc2, 2*tc*1, 2*tc*2 Coating liquid curtain formed outside the web upper surface
tc2, 2*tc*2 Coating liquid curtain of thicker film thickness of the coating liquid curtain outside the web upper surface
t Coating liquid.

What is claimed:

1. A process for coating a moving web, comprising:

positionably adjusting ribs coupled to respective first or second head bodies to adjust a width of at least a first portion of a slit between a first and second head body of a curtain head;

coupling packings to seal ends of the first and second head bodies and to define at least a portion of an end of the slit; and supplying a coating liquid through the first portion of the slit and through a second portion of the slit located outside of an edge of the moving web, whereby a coating liquid curtain extends across the web and beyond the edges of the web, wherein, due to slit width differences in a web travel direction between the first and second portions of the slit, a flow rate for the coating liquid through the second portion of the slit is greater than a flow rate for the coating liquid through the first portion of the slit.

2. The method in accordance with claim 1, wherein the slit width of the second portion of the slit is no less than twice the width of the slit width of the first portion.

3. A process for coating a web with a curtain coater composed of a curtain head, formed by at least a first and second head body, having a slit structured and arranged such that a first portion of the slit supplies a coating liquid curtain at least onto a surface of a moving web, positionably adjustable ribs coupled to respective first or second head bodies; and at least a second portion of the slit being located outside an edge of the moving web and having a width in a direction of web movement greater than the width of the first portion of the slit said process comprising:

adjusting a slit width of at least the first portion with the adjustable ribs;

defining at least a portion of an end of the slit with packings for sealing ends of the first and second head body;

forming a coating liquid curtain having an extent greater than a width of the web;

drawing the web through the curtain; and supplying the coating liquid through at least a portion of the slit forming the coating liquid curtain outside of the edges of the web, which has a width greater than a portion of said slit forming the coating liquid curtain supplied onto the web.

4. A process for coating a web with a curtain coater composed of a curtain head, formed by at least a first and second head body, having a slit structured and arranged such that a first portion of the slit defined at least in part by an adjustable rib coupled to one of the first and second head body supplies a coating liquid curtain at least across a surface of a moving web, and the slit has a second portion structured to form at least a portion of the coating liquid curtain beyond the edges of the web at a greater flow rate than through the first portion of the slit, said process comprising:

adjusting a slit width of at least the first portion with the adjustable ribs;

sealing ends of the first and second head with packings defining at least a portion of an end of the slit;

forming a coating liquid curtain having an extent greater than a width of the web;

drawing the web through the curtain; and supplying the coating liquid through at least a the second portion of the slit at a greater flow rate than through the first portion of the slit due to differences between respective widths between the first and second portions of the slit in a web moving direction.

5. The method in accordance with claim 4, wherein the second portion of the slit has a width greater than no less than twice the width of the first portion of the slit.

6. A curtain coater comprising:

a curtain head, formed by at least a first and second head body, having a slit structured and arranged such that a first portion of the slit supplies a coating liquid curtain at least onto a surface of a moving web;

positionably adjustable ribs coupled to respective first or second head bodies to variably define a width of at least the first portion of the slit;

at least a second portion of said slit being located outside of edges of the moving web and having a width in a direction of web movement greater than the width of the first portion of said slit; and packings coupled to seal ends of the first and second head bodies and to define at least a portion of an end of the slit.

7. The curtain coater in accordance with claim 6, wherein the greater width of the second portion of the slit is no less than twice the width of the first portion of the slit.

8. The curtain coater in accordance with claim 6, wherein coating liquid is supplied to said slit under pressure.

9. The curtain coater in accordance with claim 6, wherein said curtain head is positioned above an upper surface of the web.

10. The curtain coater in accordance with claim 6, wherein at least end parts of said slit are wider in width than a remaining portion of said slit.

11. A curtain coater comprising:

a curtain head, formed by at least a first and second head body, having a slit structured and arranged such that a first portion of the slit defined at least in part by an adjustable rib coupled to one of the first and second head body supplies a coating liquid curtain at least across a surface of a moving web;

packings arranged to seal ends of the first and second head body and to define at least a portion of an end of the slit; and said slit having a second portion structured to form at least a portion of the coating liquid curtain beyond the edges of the web at a greater flow rate than through the first portion of said slit due to differences between respective widths between the first and second portions of the slit in a web moving direction.

12. The curtain coating in accordance with claim 11, wherein the second portion of the slit is wider, in a web moving direction, than the first portion of the slit.

* * * * *